US012599828B2

(12) United States Patent
Chang et al.

(10) Patent No.: US 12,599,828 B2
(45) Date of Patent: Apr. 14, 2026

(54) SPIN CALCULATION METHOD FOR GOLF BALL MOVING BY BEING HIT AND SPIN CALCULATION APPARATUS USING SAME

(71) Applicant: GOLFZON CO., LTD., Seoul (KR)

(72) Inventors: Soo Ho Chang, Seoul (KR); Min Kyung Sim, Seoul (KR)

(73) Assignee: GOLFZON CO., LTD., Seoul (KR)

( * ) Notice: Subject to any disclaimer, the term of this patent is extended or adjusted under 35 U.S.C. 154(b) by 354 days.

(21) Appl. No.: 18/282,258

(22) PCT Filed: Mar. 25, 2022

(86) PCT No.: PCT/KR2022/004180

§ 371 (c)(1),
(2) Date: Sep. 15, 2023

(87) PCT Pub. No.: WO2022/211377

PCT Pub. Date: Oct. 6, 2022

(65) Prior Publication Data

US 2024/0157218 A1 May 16, 2024

(30) Foreign Application Priority Data

Mar. 30, 2021 (KR) ..... 10-2021-0040978

(51) Int. Cl.
*A63B 69/36* (2006.01)
*A63B 24/00* (2006.01)

(52) U.S. Cl.
CPC .. *A63B 69/3658* (2013.01); *A63B 2024/0034* (2013.01); *A63B 2220/35* (2013.01); *A63B 2220/806* (2013.01)

(58) Field of Classification Search
CPC ..... A63B 69/3658; A63B 2024/0034; A63B 2220/35; A63B 2220/806; A63B 69/36;
(Continued)

(56) References Cited

U.S. PATENT DOCUMENTS 4,158,853 A * 6/1979 Sullivan ..... A63B 24/0021 348/157
5,471,383 A * 11/1995 Gobush ..... G01P 3/38 700/91

(Continued)

FOREIGN PATENT DOCUMENTS

JP 2001-304830 A 10/2001
JP 3235987 B2 12/2001

(Continued)

OTHER PUBLICATIONS

International Search Report for PCT/KR2022/004180 mailed Jul. 5, 2022 from Korean Intellectual Property Office.

*Primary Examiner* — Nini F Legesse
(74) *Attorney, Agent, or Firm* — Revolution IP, PLLC

(57) ABSTRACT

A spin calculation method for a golf ball moving by being hit according to an embodiment of the present invention comprises: acquiring a first image and a second image, which are consecutive images for the golf ball with a plurality of markers to be hit and moved, respectively; processing to obtain information on a reference marker and a plurality of peripheral markers around the reference marker for a plurality of markers on a first ball image corresponding to a golf ball in the first image; specifying a combination of markers corresponding to the reference marker and the peripheral markers on the first ball image among markers in a second ball image corresponding to a golf ball in a second image; and processing to calculate a spin axis and a spin amount of the moving golf ball using each center point of a pair of markers corresponding to each other on the first ball image and the second ball image.

10 Claims, 9 Drawing Sheets

(a)

(b)

(58) Field of Classification Search
CPC ..... A63B 24/0021; A63B 2024/0028; G06T 7/20; G06T 7/246; G06T 7/73; G06T 2207/30204
USPC ..... 473/151, 199, 200, 252, 266, 407, 409
See application file for complete search history.

(56) References Cited

U.S. PATENT DOCUMENTS

| | | | | |
|---|---|---|---|---|
| 6,398,670 | B1 * | 6/2002 | Engelhardt | G01S 5/16 473/409 |
| 7,324,663 | B2 | 1/2008 | Kiraly | |
| 2001/0043757 | A1 * | 11/2001 | Asakura | G06T 7/73 382/289 |
| 2010/0210377 | A1 * | 8/2010 | Lock | A63B 69/3658 473/409 |
| 2012/0302379 | A1 * | 11/2012 | Margoles | A63B 60/42 473/407 |
| 2015/0350609 | A1 | 12/2015 | Kim | |
| 2019/0282854 | A1 | 9/2019 | Tuxen et al. | |
| 2024/0157218 | A1 * | 5/2024 | Chang | G06T 7/246 |

FOREIGN PATENT DOCUMENTS

| | | | |
|---|---|---|---|
| KR | 10-2010-0102583 | A | 9/2010 |
| KR | 10-1182393 | B1 | 9/2012 |
| KR | 10-1386793 | B1 | 4/2014 |
| KR | 10-2014-0139453 | A | 12/2014 |
| KR | 10-2101512 | B1 | 4/2020 |
| KR | 10-2020-0123098 | A | 10/2020 |

* cited by examiner (a)

(b)

(a)

(B)

SPIN CALCULATION METHOD FOR GOLF BALL MOVING BY BEING HIT AND SPIN CALCULATION APPARATUS USING SAME

CROSS REFERENCE TO PRIOR APPLICATIONS

This application is the 35 U.S.C. 371 national stage of international application PCT/KR2022/004180 filed on Mar. 25, 2022 which claims priority to Korean Patent Application No. 10-2021-0040978 filed on Mar. 30, 2021. The entire contents of each of the above-identified applications are hereby incorporated by reference.

TECHNICAL FIELD

The present invention is related to a spin calculation method for golf ball moving by being hit and spin calculation apparatus using same that spin information of the golf ball can be calculated through the analysis of markers displayed on the surface of the golf ball in the image taken for the golf ball moving as the user hits the golf ball with the golf club.

BACKGROUND ART

In the case of ball-based sports games, especially golf, there have always been attempts to apply the results of calculating the physical characteristics of the moving ball by sensing the ball moving by the golfer's swing to the so-called screen golf field.

In particular, it is quite difficult to measure the spin of the ball flying by a golf shot because the flying ball rotates at very high speed around the axis in three-dimensional space. quite expensive equipment is required to accurately measure the spin of the flying ball, and there is a typical method of using a radar sensor.

However, expensive sensing devices such as a radar sensor are not suitable as sensing devices commonly used for so-called screen golf or ball moving analysis on golf practice courses that sense the ball hit by a golf swing to calculate the trajectory of the ball and implement golf simulation images on a virtual golf course. It is necessary to develop a technology that can quickly and accurately sense the spin of the ball even in a relatively inexpensive and low-functional system.

In addition to the radar sensor as described above, a sensing system using cameras is used as a device for sensing the spin of the flying ball.

The camera sensing system calculates the spin of the golf ball, which is the subject, by capturing an image, extracting and analyzing a part corresponding to the golf ball from the captured image when the golf ball is hit and moved.

Since the golf ball has a significant high-speed spin when being hit and moved, a high-speed camera with a high frame rate should be used when calculating the spin of the golf ball using the camera sensing system as described above.

There are two main methods of sensing the spin of the golf ball using a camera sensing system. One is a method of calculating spin by extracting from a golf ball image a specific marker that is marked artificially on the golf ball for a spin calculation and analyzing how the extracted marker moved. The other is a method of detecting and analyzing logos or dimples of the golf ball originally provided on the golf ball through the golf ball image, and calculating spin based on the result of the analysis.

In the latter case, there are problems that cameras having high-resolutions and high frame rate are needed because the unspecified indicia such as logos or dimples on the golf ball must be analyzed, and that the accuracy of the spin calculation results is not constant because each time the golf ball is sensed, the unspecified indicia on the golf ball must be found in the captured image to determine whether indicia on a ball and another indicia on another ball are similar.

As prior arts corresponding to the former, Korean Patent No. 10-1386793, Korean Patent No. 10-1182393, Japanese Patent No. 3235987, and U.S. Pat. No. 732,463 are disclosed.

The prior arts as described above matches based on the shape characteristics of specific markers marked on golf balls. In other words, it has the advantage of being able to calculate spins accurately to some extent because specific markers of each of the two consecutive ball images are compared with each other and the two markers are matched with each other based on shape similarities.

However, when matching based on the shape characteristics of the specific markers on the golf balls for spin calculation, there is a problem of using an expensive camera device with very high frame rate because a specific marker on the golf ball must be secured on the captured image despite the fast spin speed. And in order to calculate spin, the specific markers must be extracted through image processing for the captured images and the shape similarity between the markers on the two ball images must be determined, which has a problem of slow computation speed due to the large amount of computation.

DISCLOSURE

Technical Problem

It is an object of the present invention to provide a spin calculation method for golf ball moving by being hit and spin calculation apparatus using same that when the camera captures a hit golf ball with a plurality of markers marked on the golf ball, it can quickly and accurately match markers between two consecutive ball images using the relative relationship between the plurality of the markers detected in the captured ball image so that it can increase the processing speed and the calculation accuracy of the spin of the moving golf ball.

Technical Solution

In accordance with an aspect of the present invention, the above and other objects can be accomplished by the provision of a spin calculation method for a golf ball moving by being hit, the method comprising: acquiring a first image and a second image, which are consecutive images for the golf ball with a plurality of markers to be hit and moved, respectively; processing to obtain information on a reference marker and a plurality of peripheral markers around the reference marker for a plurality of markers on a first ball image corresponding to a golf ball in the first image; specifying a combination of markers corresponding to the reference marker and the peripheral markers on the first ball image among markers in a second ball image corresponding to a golf ball in a second image; and processing to calculate a spin axis and a spin amount of the moving golf ball using each center point of a pair of markers corresponding to each other on the first ball image and the second ball image.

Preferably, the specifying the combination of markers includes specifying a combination of markers on the second ball image having a relative relationship being matched with a relative relationship of each of the plurality of peripheral markers to the reference marker on the first ball image.

Preferably, the specifying the combination of markers includes: processing to calculate relative angle information on slope of each of the plurality of peripheral markers based on a slope of the reference marker on the first ball image as feature information; processing to calculate relative angle information on slope of markers in each combination for every combination of an arbitrarily selected reference marker and a plurality of peripheral markers based on the selected reference marker on the second ball image; and specifying a combination of markers on the second ball image matched by matching the feature information on the first ball image with relative angle information on the markers on the second ball image.

Preferably, the processing to calculate the spin axis and the spin amount includes: representing each center point of a pair of markers corresponding to each other on the first ball image and the second ball image, on a single sphere; and determining a line where a line connecting each center point of each of the pairs of markers corresponding to each other and two or more planes derived from the center point of the sphere meet as the spin axis.

Preferably, the processing to calculate the spin axis and the spin amount includes: processing to calculate vectors each of which is in a direction perpendicular to the spin axis from each center point of the pair of markers corresponding to each other; projecting each of the calculated vectors on a reference plane perpendicular to the spin axis; and processing to calculate the spin amount centered on the spin axis using the vectors projected on the reference plane.

Preferably, the method further comprises: processing to calculate an amount of gaze rotation by position in the acquired image according to the camera's view fixed; and subtracting the calculated amount of gaze rotation from the calculated spin amount.

In accordance with another aspect of the present invention, there is provided a spin calculation apparatus for a golf ball moving by being hit, the apparatus comprising: a single camera that acquires a first image and a second image, which are consecutive images for the golf ball with a plurality of markers to be hit and moved, respectively, wherein the single camera is provided separately from a camera system of a sensing device that detects a motion of the golf ball; a marker matching processor that processes to obtain information on a reference marker and a plurality of peripheral markers around the reference marker for a plurality of markers on a first ball image corresponding to a golf ball in the first image, and specifies a combination of markers corresponding to the reference marker and the peripheral markers on the first ball image among markers in a second ball image corresponding to a golf ball in a second image; and a spin calculator that processes to calculate a spin axis and a spin amount of the moving golf ball by geometric calculation using each center point of a pair of markers corresponding to each other on the first ball image and the second ball image.

In accordance with another aspect of the present invention, there is provided a spin calculation apparatus for a golf ball moving by being hit, the apparatus comprising: a marker matching processor that receives a first image and a second image, which are consecutive images for the golf ball with a plurality of markers to be hit and moved from a camera of a sensing device that detects a motion of the moving golf ball so as to process to obtain information on a reference marker and a plurality of peripheral markers around the reference marker for a plurality of markers on a first ball image corresponding to a golf ball in the first image, and specify a combination of markers corresponding to the reference marker and the peripheral markers on the first ball image among markers in a second ball image corresponding to a golf ball in a second image; and a spin calculator that processes to calculate a spin axis and a spin amount of the moving golf ball by geometric calculation using each center point of a pair of markers corresponding to each other on the first ball image and the second ball image.

Preferably, the marker matching processor is configured to receive coordinate information on which the golf ball is placed from the sensing device, set a region of an image to be acquired by the single camera as a region of interest based on the coordinate information, and obtain the set region of interest as the first image and the second image.

Preferably, the marker matching processor is configured to: process to calculate relative angle information on slope of each of the plurality of peripheral markers based on a slope of the reference marker on the first ball image as feature information, process to calculate relative angle information on slope of markers in each combination for every combination of an arbitrarily selected reference marker and a plurality of peripheral markers based on the selected reference marker on the second ball image, and specify a combination of markers on the second ball image matched by matching the feature information on the first ball image with relative angle information on the markers on the second ball image.

Preferably, the spin calculator is configured to: represent each center point of a pair of markers corresponding to each other on the first ball image and the second ball image, on a single sphere, and determine a line where a line connecting each center point of each of the pairs of markers corresponding to each other and two or more planes derived from the center point of the sphere meet as the spin axis, and process to calculate vectors each of which is in a direction perpendicular to the spin axis from each center point of the pair of markers corresponding to each other, project each of the calculated vectors on a reference plane perpendicular to the spin axis, and process to calculate the spin amount centered on the spin axis using the vectors projected on the reference plane.

Advantageous Effects

The spin calculation method for golf ball moving by being hit and spin calculation apparatus using same according to the present invention have an advantageous effect that when the camera captures a hit golf ball with a plurality of markers marked on the golf ball, it can quickly and accurately match markers between two consecutive ball images using the relative relationship between the plurality of the markers detected in the captured ball image so that it can increase the processing speed and the calculation accuracy of the spin of the moving golf ball.

DESCRIPTION OF DRAWING (a) of FIG. 1 is a block diagram showing the configuration of the device for spin calculation according to an embodiment of the present invention, and (b) of FIG. 1 is a block diagram showing the configuration of the device for spin calculation according to another embodiment of the present invention.

BEST MODE

A spin calculation method for golf ball moving by being hit and spin calculation apparatus using same according to the present invention will be more specifically described with reference to the drawings.

The present invention can basically calculate spin of a flying golf ball hit by a user by capturing images the hit golf ball with a predetermined camera and analyzing the captured image. The spin calculation apparatus according to the present invention may be implemented as a spin calculation function executed by a sensing device that senses the movement of the golf ball, or may be implemented as a device that calculates spin using a single camera for spin calculation.

Figure 1:
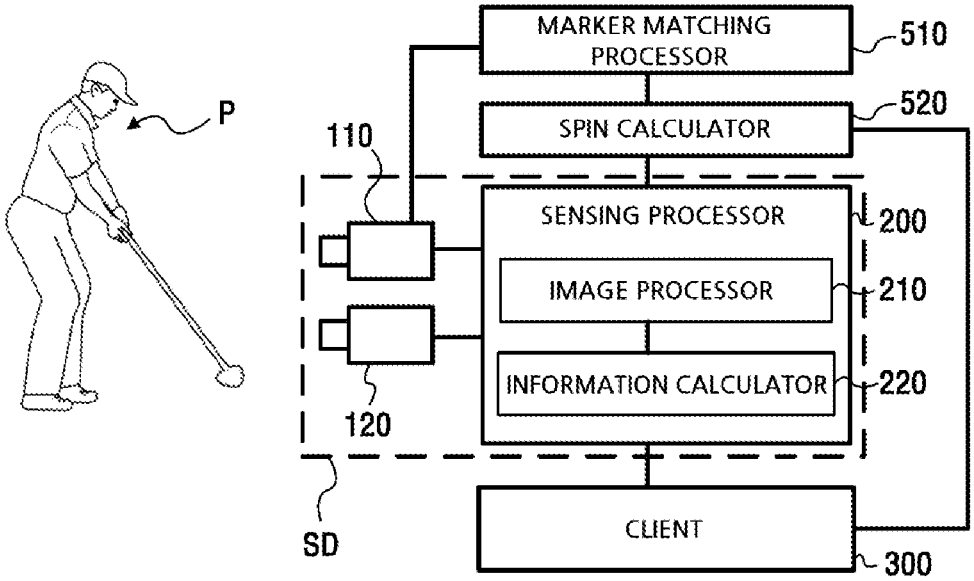
Figure 1:
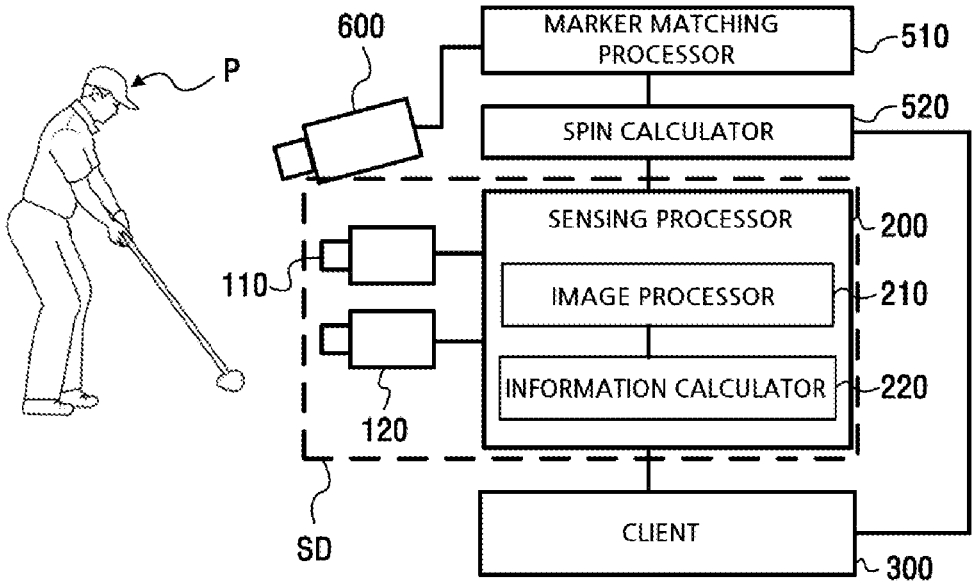

An example of the former is shown in FIG. 1(*a*), and an example of the latter is shown in FIG. 1(*b*).

First, an embodiment of the present invention shown in FIG. 1(*a*) will be described. The spin calculation apparatus according to an embodiment of the present invention is a device that calculates spin using the camera 110 or 120 of the sensing device SD, and may include a marker-matching processor 510 and a spin calculator 520.

Wherein the sensing device SD may be a device that calculates the three-dimensional coordinates of the golf ball moving in space by capturing images of the golf ball moving as the user P hits the golf ball and analyzing the captured images, and calculates information on kinetic characteristics such as an initial speed of the golf ball, a direction angle of the golf ball, and a height angle of the golf ball based on the three-dimensional coordinates of the golf ball moving in space.

The sensing device SD can be applied to various fields such as analysis of balls hit and flying according to the user's golf swing or virtual golf using virtual reality-based simulation images.

The sensing device SD may include cameras 110 and 120 and a sensing processor 200.

The camera of the sensing device SD is configured to consecutively acquire images at a field of view looking at the moving golf ball. In order to calculate position information on a three-dimensional space for the moving golf ball, a plurality of cameras need to acquire images for the same object at different locations. For example, as shown in FIG. 1(*a*) and FIG. 1(*b*), the cameras of the sensing device SD may be configured in a stereoscopic manner by synchronizing the first camera 110 and the second camera 120.

By configuring the cameras of the sensing device in the stereoscopic manner in which the cameras 110, 120 are synchronized with each other, two-dimensional information of the golf ball extracted from each of the images acquired through the first camera 110 and the second camera 120 for the same object (golf ball) can be converted into three-dimensional information.

The sensing processor 200 of the sensing device SD may include an image processor 210 that collects images from the cameras 110 and 120 and performs a predetermined image processing to extract the golf ball, and an information calculator 220 that calculates three-dimensional position information from the two-dimensional position information extracted from the image.

The sensing processor 200 may extract the moving golf ball from each image captured by each camera 110 and 120, calculate the position information of each extracted golf ball, and transmit it to the client 300. The client 300 may perform functions implemented by the client 300, such as calculating new information or calculating analysis information using the position information of the golf ball transmitted from the sensing processor.

For example, in the case that the client 300 is implemented as a simulator used in a screen golf system, the simulator can receive the position information of the golf ball and the golf club from the sensing processor 200 and use it to implement a simulation image of the trajectory in which the virtual golf ball flies on a virtual golf course.

In addition, in the case that the client 300 is implemented as a golf swing analysis device, the analysis device can receive the position information of the golf ball and golf club from the sensing processor 200 and use it to provide analysis information on the user's golf swing, diagnosis of swing problems, and problem solving.

The image processor 210 may be configured to perform image processing to extract a difference image of each of the images consecutively acquired by the cameras 110, 120 based on a reference image, and the information calculator 220 may be configured to calculate position information of the moving golf ball from each of the difference images extracted by the image processor.

As a method of extracting the moving golf ball from the acquired image, in addition to using the difference image as described above, a template image for the golf ball may be prepared in advance and a part corresponding to the golf ball may be extracted through similarity between an object on each acquired image and the template.

The spin calculation apparatus according to the embodiment described in FIG. 1(*a*) receives a ball image from one of the plurality of cameras of the sensing device SD, calculates the spin of the moving golf ball through the marker matching processor 510 and the spin calculator 520, and delivers it to the client 300.

Meanwhile, the spin calculation apparatus according to another embodiment described in FIG. 1(*b*) is configured to include a single camera 600 for spin calculation for golf balls apart from the sensing device SD. This spin calculation apparatus may include a marker matching processor 510 and a spin calculator 520 that calculate spins using ball images captured by the single camera 600.

One of the plurality of the cameras 110, 120 of the sensing device SD or the single camera 600 of the embodiment shown in FIG. 1(*b*) may acquire a first image and a second image, which are consecutive images of the golf ball with a plurality of markers being hit and move, respectively.

For example, the image of the n-th frame of the camera or the single camera may be referred to as a first image, and the image of the n+1-th frame may be referred to as a second image.

A part corresponding to the golf ball included in the first image may be extracted to generate a first ball image, and a part corresponding to the golf ball included in the second image may be extracted to generate a second ball image. The marker matching processor 510 and the spin calculator 520 may calculate spin by analyzing the first ball image and the second ball image, respectively.

The marker matching processor 510 may find and specify a plurality of markers on each ball image. In addition, the marker matching processor 510 may calculate information on a reference marker and a plurality of peripheral markers around the reference marker among the plurality of markers specified on the first ball image. In addition, the marker matching processor 510 may find and specify a combination of markers corresponding to the reference marker and the peripheral markers of the first ball image in the second ball image.

The spin calculator 520 may calculate the spin axis and the spin amount by geometric calculation using each center point of pairs of corresponding markers between the first ball image and the second ball image.

Specific operations of the marker matching processor and the spin calculator will be described later.

Meanwhile, the method for spin calculation according to an embodiment of the present invention will be described with reference to a flowchart shown in FIG. 2.

First, by a camera of the sensing device or a single camera, consecutive images including a first image of a golf ball with a plurality of markers and a second image continuous thereto are obtained (S110).

Using the acquired images as described above, the marker matching processor extracts and analyzes the plurality of the markers on the golf ball from the images to determine a combination of markers corresponding between the markers of the golf ball on the first image and the markers of the golf ball on the second image. This may be performed through steps S120 to S160 on the flowchart of FIG. 2.

After acquiring the first image and the second image in step S110, a part corresponding to the golf ball on the first image is extracted as the first ball image, and a part corresponding to the golf ball on the second image is extracted as the second ball image (S120).

The marker matching processor defines or specifies a reference marker and a plurality of peripheral markers among a plurality of markers on the first ball image (S130). The marker matching processor may process to calculate information on a relative relationship of each of the plurality of the peripheral markers with respect to the reference marker on the first ball image.

The relative relationship of each of the peripheral markers to the above reference marker can be defined according to the shape or phase of the plurality of markers on the golf ball. For example, if a plurality of markers on a golf ball have different phases, that is, they are inclined at different slopes, the above relative relationship of each of the peripheral markers to the reference marker can be implemented as relative angle information of each of the peripheral markers to the reference marker.

That is, the marker matching processor specifies or defines a reference marker and a plurality of peripheral markers for a plurality of markers on the first ball image (S130). In addition, the marker matching processor may process to calculate relative angle information on the slope of each of the peripheral markers for the reference marker on the first ball image as 'feature information' (S140).

The marker matching processor processes to calculate relative angle information on the slope in each combination which has an arbitrarily selected reference marker and peripheral markers based on the selected reference marker on the second ball image (S150). In this way, the feature information on the markers on the first ball image can be matched with the relative angle information on the markers on the second ball image so that the matched combination of markers on second ball image can be specified (S160).

Specific examples related to matching of markers as described above are shown in FIGS. 3 to 6.

Figure 3:
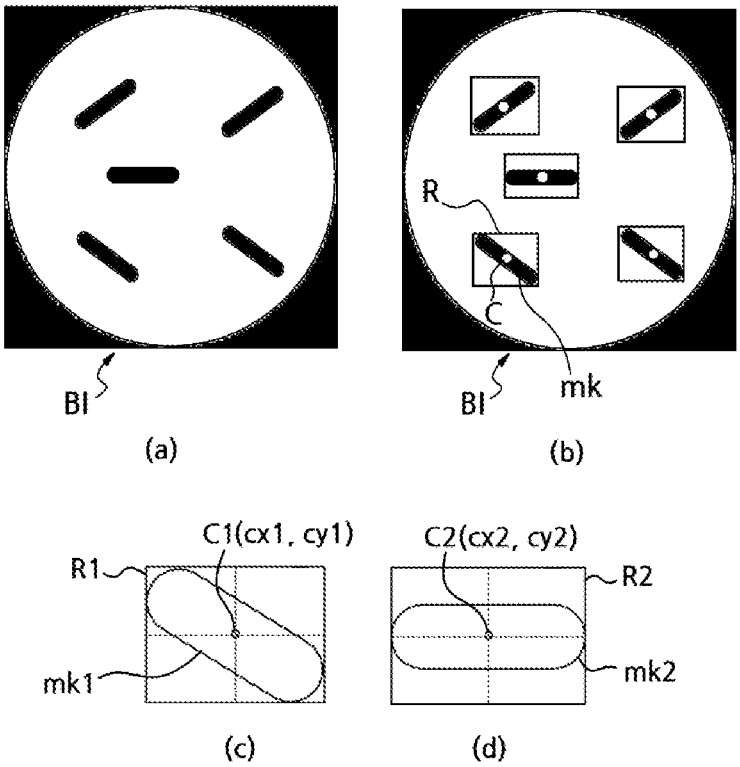
FIG. 3 shows an example of a ball image for the golf ball with a plurality of the markers marked on a surface of the golf ball used in the device for spin calculation and the method for the same according to an embodiment of the present invention, and detecting the markers in the ball image and specifying coordinates of each center point of the detected markers.

FIG. 3 shows an example of a ball image for the golf ball with a plurality of the markers marked on a surface of the golf ball used in the device for spin calculation and the method for the same according to an embodiment of the present invention, and detecting the markers in the ball image and specifying coordinates of each center point of the detected markers.

Figure 4:
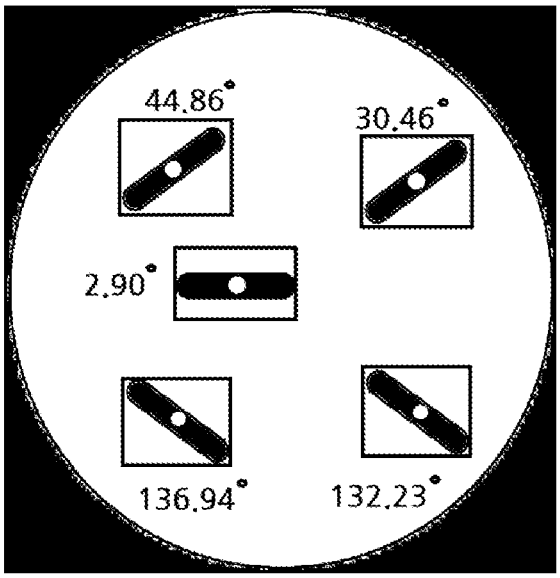
FIG. 4 shows a result of specifying the markers on the ball image as shown in (b) of FIG. 3 and calculating slope information of each of the markers.

FIG. 4 shows a result of specifying the markers on the ball image as shown in FIG. 3(*b*) and calculating slope information of each of the markers.

Figure 5:
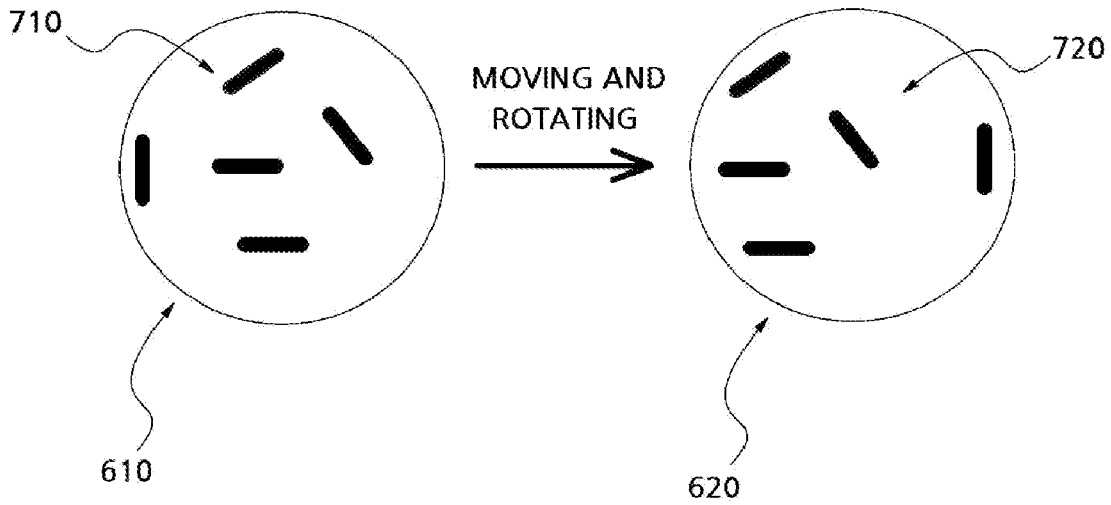
FIGS. 5 and 6 show a process of matching markers on the first ball image with markers on the second ball image by the device and method for spin calculation according to an embodiment of the present invention.
Figure 6:
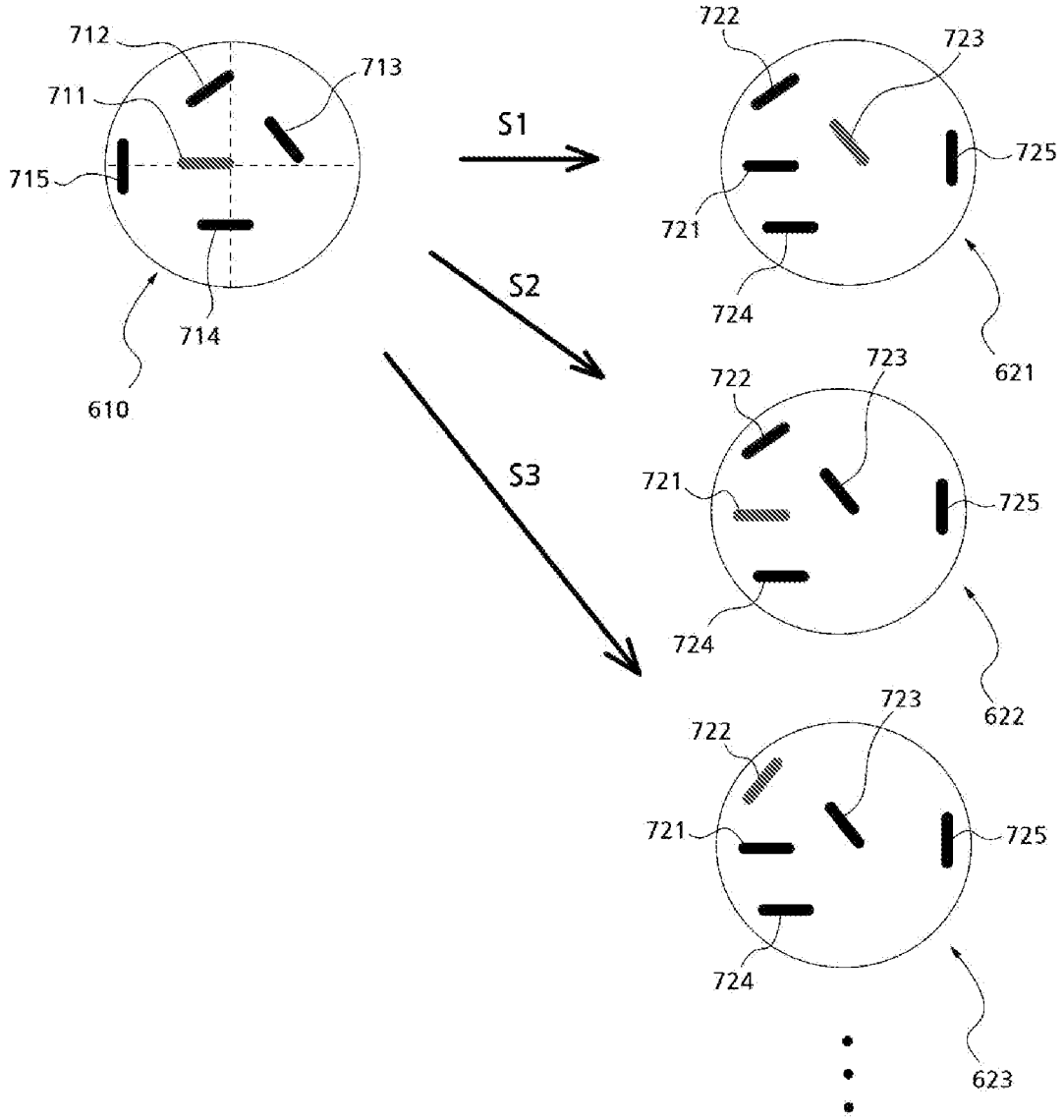

FIGS. 5 and 6 are illustrated for explaining a process of matching markers on the first ball image with markers on the second ball image.

First, with reference to FIG. 3, FIG. 3(*a*) shows a ball image of an image captured with respect to a golf ball on which a plurality of markers are marked. FIG. 3(*b*) shows the results of specifying each marker using marker regions for each marker on the ball image shown in FIG. 3(*a*) and determining center point coordinates of each marker. FIG. 3(*c*) and FIG. 3(*d*) show enlarged each of the markers and the marker regions shown in FIG. 3(*b*).

As shown in FIG. 3(*a*), the golf ball used in the present invention has a plurality of markers marked on its surface and the plurality of the markers mk can be identified on the ball image BI.

The plurality of the markers on the golf ball may be a plurality of markers with the same shape or a plurality of markers with different shapes as shown in FIG. 3(*a*).

In any case, it is preferable that the plurality of the markers are formed to produce relative information through relationships with other markers based on one reference marker.

For example, as shown in FIG. 3(*a*), when a plurality of markers mk having the same shape are marked to have different phases (i.e., slopes), relative angle information on the slopes of each of the remaining markers based on one reference marker may be processed to calculate, and the relative angle information on the slopes may be feature information for marker matching.

In the ball image BI shown in FIG. 3(*a*), the marker matching processor may specify each of the markers mk, specify marker regions R for each of the markers mk, that is, an area containing each marker mk, and specify the center point C of each marker mk by each marker region R.

As shown in FIG. 3(*c*), a marker region R1 may be created to include an inclined marker mk1, and the center point coordinates cx1, cy1 may be processed to calculate using the center point C1 of the marker region R1 as the center point of the marker.

In the case of FIG. 3(*d*), the marker mk2 is horizontally represented, and rather than setting the marker region R2 to be in close contact with the marker mk2, it is preferable to set the marker region R2 to have a predetermined size to include a certain background with the marker mk2.

In the case of FIG. 3(*d*), when the marker region R2 is specified, coordinates cx2, cy2 may be calculated using the center point C2 of the marker region R2 as the center point of the marker mk2.

In addition, not only the center point coordinates of each specified marker but also the slope information of each marker may be calculated.

The slope angle of each marker may extract the main component of the direction gradient formed by pixels in the marker region, and define the extracted pixel gradient as the slope angle of the marker. The method of extracting the main component of the pixel gradient may use singular value decomposition (SVD).

As described above, an example of a result of calculating the slope angle of each of the plurality of markers specified in the ball image is shown in FIG. 4.

In this way, calculating the slope angle information of each of the markers shown on the ball image is applied to both the first ball image and the second ball image.

Meanwhile, referring to FIG. 5, drawing number 610 represents a first ball image, and drawing number 620 represents a second ball image. The golf ball shown in the first ball image rotates and moves to the state of the golf ball shown in the second ball image, and when matching the marker 710 on the first ball image 610 and the marker 720 on the second ball image 620, it is necessary to match the same markers.

For the matching of markers as described above, conventionally, each of the plurality of markers has been set as a figure having a different shape, and the same markers on the first ball image and the second ball image were matched with the similarity of the shape of the figure.

However, in order to match the same markers according to the similarity of the shape of the figures, there is a problem that the resolution of the camera to acquire the ball image must be quite high. In addition, even if the camera's resolution is high, the shape of the markers on the image often does not appear completely, so matching the markers to each other by the similarity of the shape is less accurate.

The present invention does not process matching markers on the basis of the shape of a figure, but process matching markers using the slope information of each of the plurality of markers described above, which can significantly speed up the operation for marker matching processing. At the same time, it has the advantage of being able to match markers quite accurately.

In the case of marker matching based on the shape of a figure of the marker, a computer must process the two-dimensional data of the figure's shape, so the speed of the operation is very slow. On the other hand, when marker matching is performed using the slope information of the marker according to the present invention, since the slope information is calculated as a single value, the calculation speed can be significantly increased in that marker matching is performed using such a slope value.

Describing in more detail with reference to FIG. 6, one of the plurality of markers on the first ball image 610 may be defined as a reference marker, and markers around the reference marker may be defined as peripheral markers.

For example, as shown in FIG. 6, the marker 711, which is closest to the center point of the first ball image 610, can be defined as a 'reference marker', and the surrounding markers based on the reference marker 711 can be defined clockwise as the first peripheral marker 712, the second peripheral marker 713, the third peripheral marker 714, and the fourth peripheral marker 715.

The present invention can process to find a combination of reference marker-peripheral markers on the second ball image 620 that match the reference marker 711 and the peripheral markers 712 to 715 defined for the markers on the first ball image 610 as described above.

To this end, relative angle information can be calculated using the slope angle information of each of the reference marker 711 and the peripheral markers 712 to 715 on the first ball image 610 as follows, which is referred to as "feature information".

TABLE 1

<Feature information>

| | Reference marker | First peripheral marker | Second peripheral marker | Third peripheral marker | Fourth peripheral marker |
|---|---|---|---|---|---|
| Slope angle | 2° | 47° | 137° | 2° | 92° |
| Relative angle | 0° | 45° | 135° | 0° | 90° |

That is, marker matching can be achieved by finding a combination of reference marker-peripheral markers with relative angle information according to the above feature information for the plurality of markers on the second ball image.

The second ball image 620 is a state rotated from the first ball image 610. Since the combination of the reference marker-peripheral markers on the first ball image 610 cannot be immediately specified, and all markers on the second ball image 620 can be the reference marker, by arbitrarily selecting a reference marker on the second ball image 620 and determining peripheral markers based on the selected reference marker, relative angle information for the reference marker and peripheral markers needs to be calculated in all cases.

For example, as shown in FIG. 6, the number 723 marker may set as a reference marker and each of the remaining peripheral markers may be set based on the marker 723 on the second ball image 621 so that relative angle information can be calculated in the case of S1, the number 721 marker may set as a reference marker and each of the remaining peripheral markers may be set based on the marker 721 on the second ball image 622 so that relative angle information can be calculated in the case of S2, and the number 722 marker may set as a reference marker and each of the remaining peripheral markers may be set based on the marker 722 on the second ball image 623 so that relative angle information can be calculated in the case of S3. In this way, each relative angle information for the combination of reference marker-peripheral markers can be calculated in all cases that each of all markers is set as a reference marker.

In FIG. 6, the relative angle information of the combination of the reference marker 723 and the peripheral markers on the second ball image 621 in the case of S1 and the relative angle information of the combination of reference markers 721 and peripheral markers on the second ball image 622 in the case of S2 are shown as follows.

TABLE 2

<In the case of S1>

| | Reference marker | First peripheral marker | Second peripheral marker | Third peripheral marker | Fourth peripheral marker |
|---|---|---|---|---|---|
| Slope angle | 49° | 94° | 4° | 4° | 139° |
| Relative angle | 0° | 45° | 135° | 135° | 90° |

TABLE 3

< In the case of S2>

| | Reference marker | First peripheral marker | Second peripheral marker | Third peripheral marker | Fourth peripheral marker |
|---|---|---|---|---|---|
| Slope angle | 4° | 49° | 139° | 4° | 94° |
| Relative angle | 0° | 45° | 135° | 0° | 90° |

Comparing the feature information in Table 1 and the relative angle information in the case of S1 in Table 2, since they do not match each other, the case of S1 is excluded.

Comparing the feature information in Table 1 and the relative angle information in the case of S2 in Table 3, it can be seen that they match each other. Accordingly, it may be seen that the combination of the markers on the second ball image matched with the feature information on the first ball image is the case of S2.

That is, in the case of S2 in FIG. 6, it may be specified that the change from the first ball image 610 to the second ball image 622 is a change due to the spin, and the combination of the reference marker-peripheral markers on the first ball image 610 can be matched with the combination of the reference marker-peripheral markers on the second ball image 622.

Figure 2:
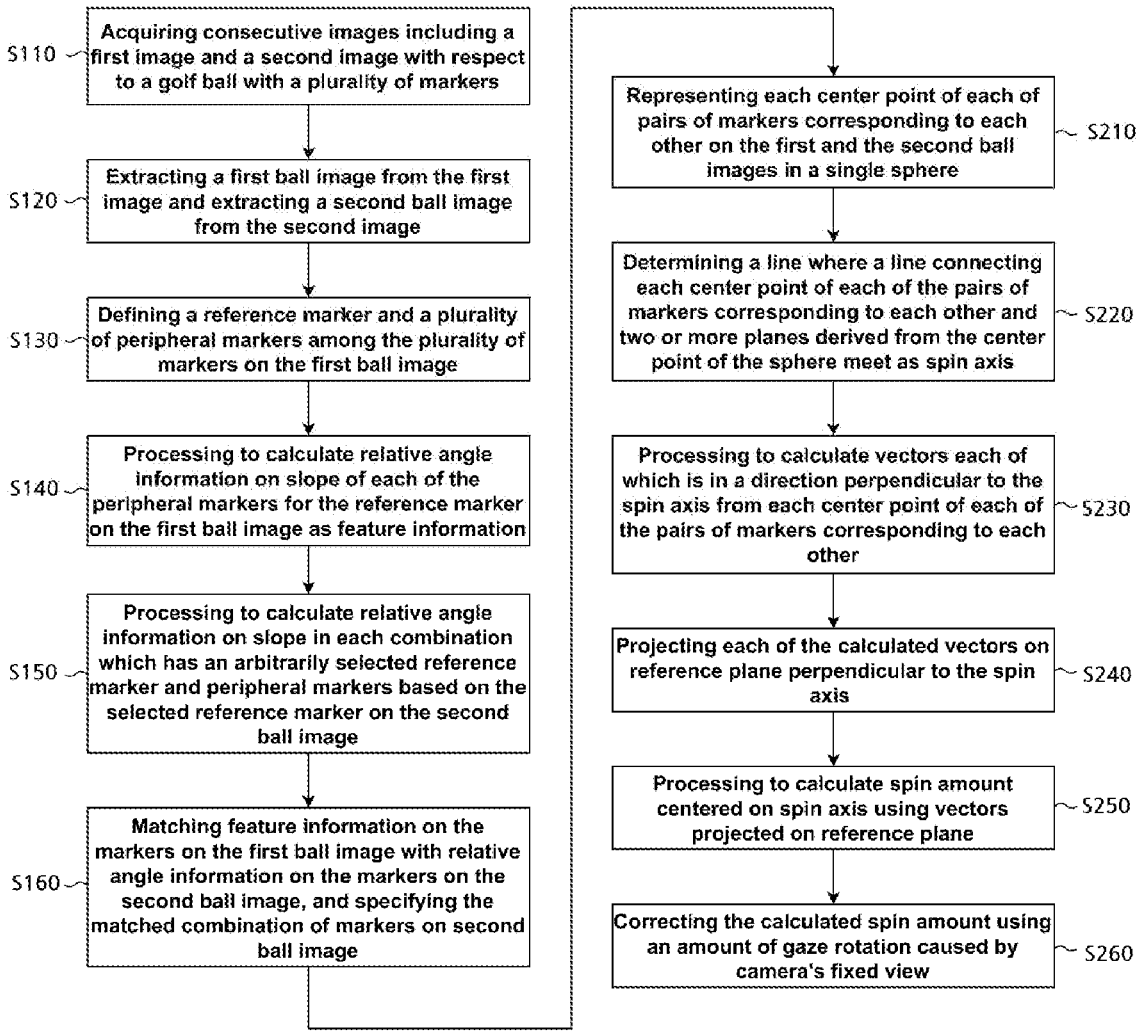
FIG. 2 is a flowchart showing the method for spin calculation according to an embodiment of the present invention.

The process as shown in FIGS. 3 to 6 as described above may be performed through the processes of S120 to S160 of the flowchart shown in FIG. 2.

Meanwhile, as shown in FIG. 2, after the marker matching described above is completed, the spin calculator may process to calculate the spin axis and the spin amount using the matched results.

For the calculation of the spin axis and the spin amount, each center point of each of pairs of markers corresponding to each other on the first ball image and the second ball image may be represented in a single sphere (S210).

Wherein a line where a line connecting each center point of each of the pairs of markers corresponding to each other and two or more planes derived from the center point of the sphere meet can be determined as the spin axis (S220).

After determining the spin axis as described above, the spin calculator may process to calculate vectors each of which is in a direction perpendicular to the spin axis from each center point of each of the pairs of markers corresponding to each other (S230). And, each of the calculated vectors may be projected on a reference plane perpendicular to the spin axis (S240).

As described above, the spin amount centered on the spin axis may be calculated using the vectors projected on the reference plane (S250).

As described above, as the spin axis and the spin amount are calculated, the spin calculator may process to calculate spin information from the first ball image to the second ball image.

However, the change from the first ball image to the second ball image is not only due to the spin of the actual golf ball. This is because the camera's gaze is fixed, and an amount of rotation is occurred by a non-rotation movement from the first ball image to the second ball image in the field of view of the camera according to movement from a position of the golf ball when capturing the first ball image to a position of the golf ball when capturing the second ball image.

As such, the amount of rotation, that is the amount of gaze rotation caused by the non-rotation movement from the first ball image to the second ball image is caused by the camera's fixed view. Accordingly, the exact spin amount of the golf ball can be calculated by calculating the amount of gaze rotation by position in the image according to the camera's view fixed, and then subtracting the calculated amount of gaze rotation from the calculated spin amount (S260).

Specific examples of calculating the spin as described above are shown in FIGS. 7 to 10.

Figure 7:
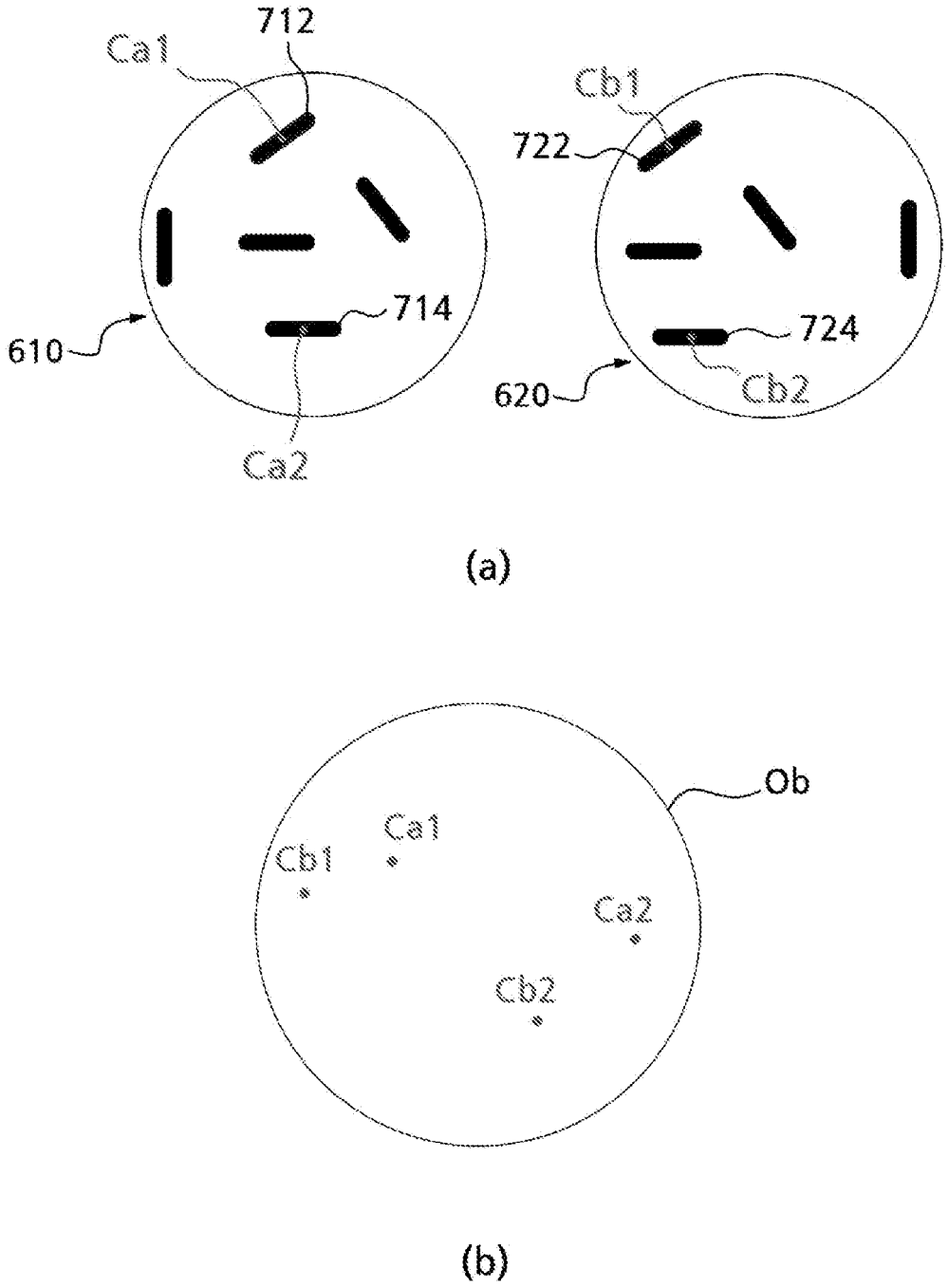
FIG. 7 is a diagram illustrating center points of each of the matched markers in one sphere according to the marker matching between the first ball image and the second ball image as shown in FIG. 6.
Figure 8:
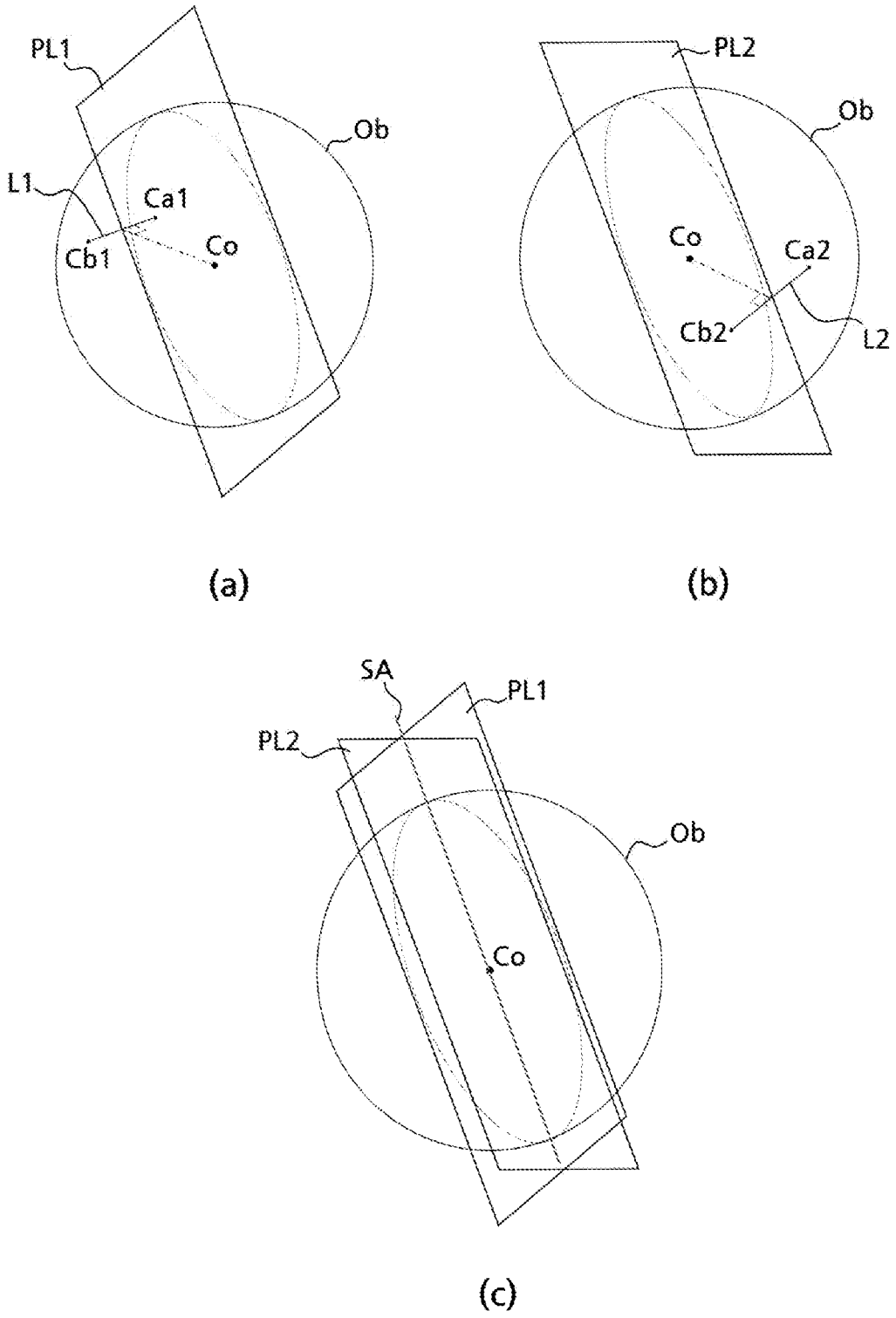
FIG. 8 shows an example of a method of calculating a spin axis using center points of the markers in the sphere shown in FIG. 7.

FIG. 7 is a diagram illustrating center points of each of the matched markers in one sphere according to the marker matching between the first ball image and the second ball image as shown in FIG. 6. FIG. 8 shows an example of a method of calculating a spin axis using the center points of the markers in the sphere shown in FIG. 7.

Figure 9:
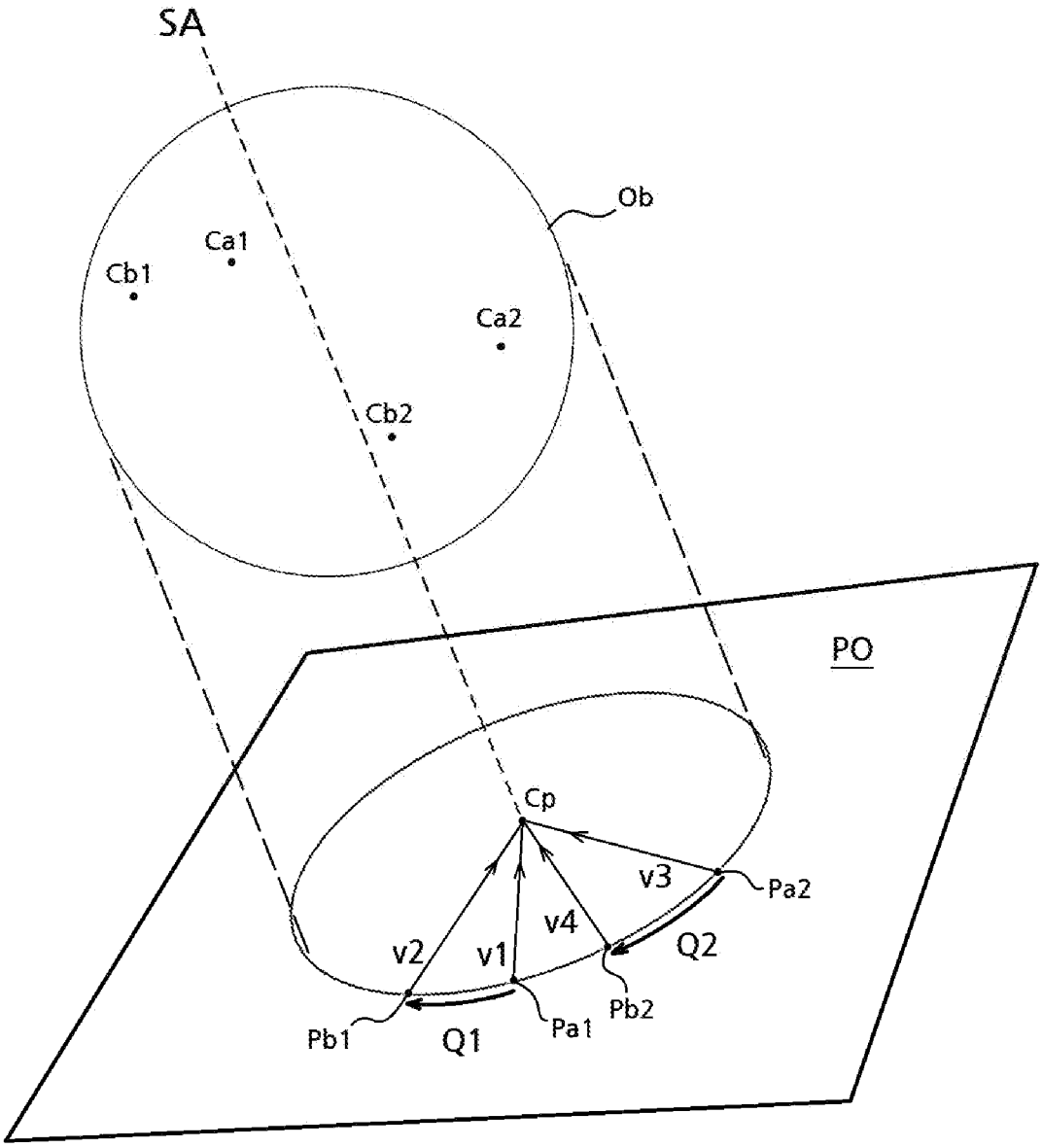
FIG. 9 shows an example of a method of calculating spin information using the spin axis and the center points of the markers in the sphere shown in FIG. 8.
Figure 10:
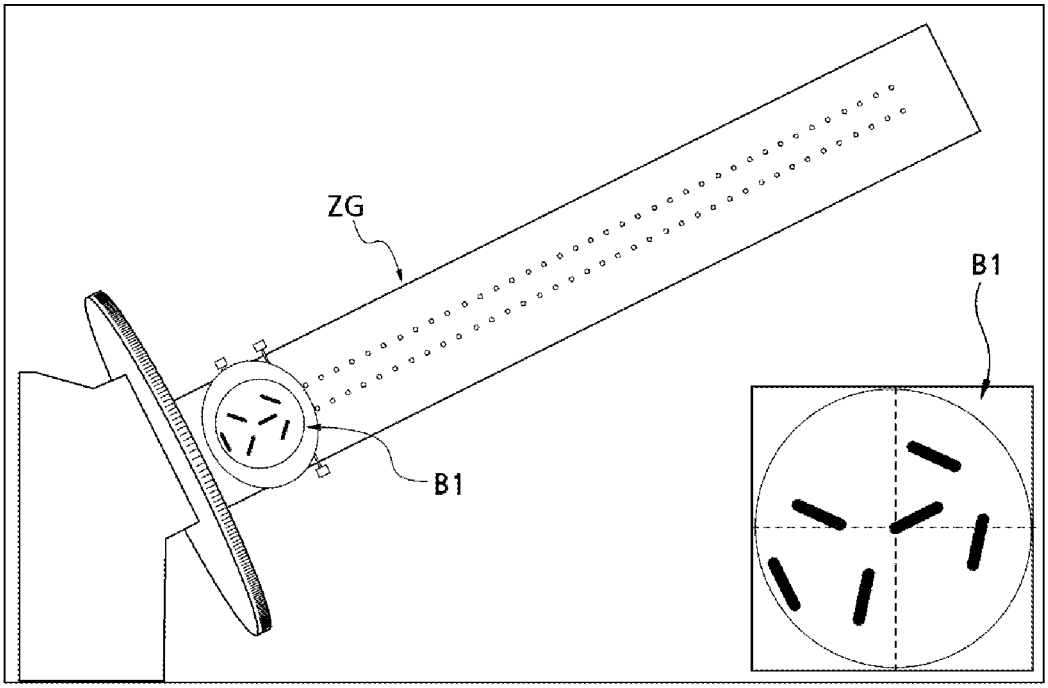
FIG. 10 shows that an amount of gaze rotation is occurred during non-rotation movement from the first ball image to the second ball image according to the camera's view fixing in the spin calculation apparatus according to an embodiment of the present invention.
Figure 10:
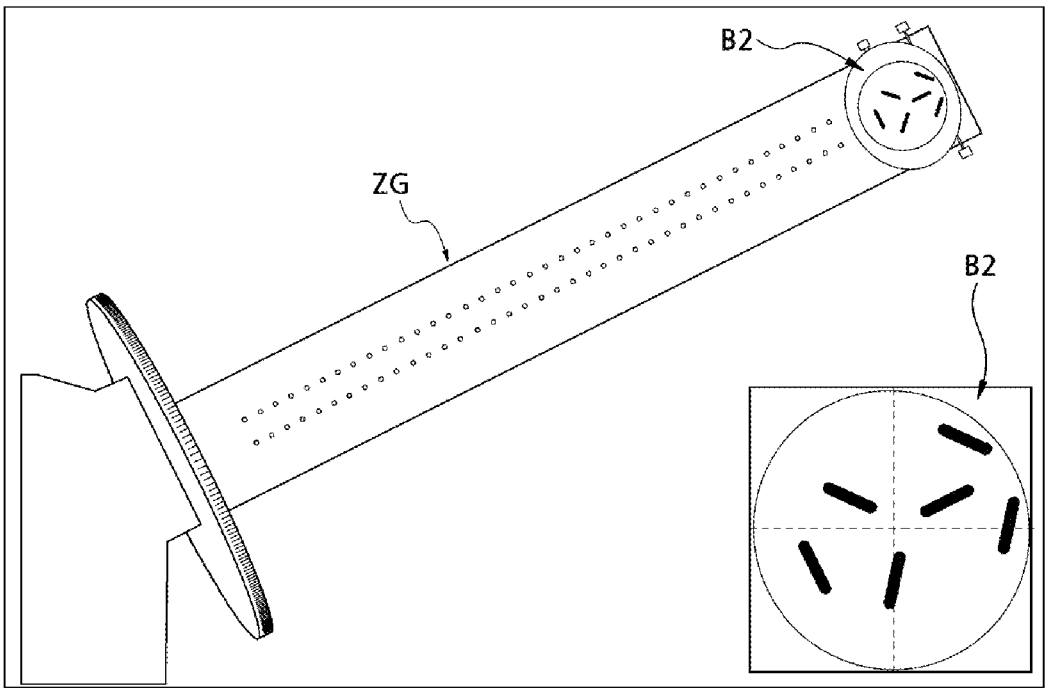

FIG. 9 shows an example of a method of calculating spin information using the spin axis and the center points of the markers in the sphere shown in FIG. 8. FIG. 10 shows that an amount of gaze rotation is occurred during a non-rotation movement from the first ball image to the second ball image according to the camera's view fixing in the spin calculation apparatus according to an embodiment of the present invention.

Referring to FIG. 7, as shown in FIG. 7(*a*), the markers 712 and 714 of the first ball image 610 and the markers 722 and 724 of the second ball image 620 are matched, respectively, and the center points Ca1-Cb1, Ca2-Cb2 of each matching marker may be represented in one sphere Ob as shown in FIG. 7(*b*).

Referring to FIG. 7(*b*), it may be seen that the sphere Ob rotates to Ca1→Cb1 and Ca2→Cb2. Wherein, the sphere Ob may be a spherical body virtually constructed based on the outline of the ball image.

Wherein the spin axis and the spin amount according to the rotation to Ca1→Cb1 and the spin axis and the spin amount according to the rotation to Ca2→Cb2 may not match each other.

The mismatch as described above may be due to an error occurring in the image analysis process because some pixels representing the marker may be lost during the analysis process of the marker.

FIG. 7 shows an example in which two pairs of center points of the markers is shown, however the present invention is not limited thereto, and more pairs of marker center points such as three pairs and four pairs may appear depending on the number of markers.

As shown in FIG. 7(*b*), the spin axis may be calculated using each center point in a state in which a pair of center points of the matched markers are indicated on the sphere Ob. This is shown in FIG. 8.

In FIG. 8(*a*) to FIG. 8(*c*), the center point of the sphere Ob is indicated as Co, and Ca1 and Cb1, and Ca2 and Cb2 are pairs of center points of markers matched with each other.

As shown in FIG. 8(*a*), a plane PL1 passing through the center point Co of the sphere Ob and perpendicular to a straight line L1 connecting the markers' center points Ca1 and Cb1 to each other can be constructed. And as shown in FIG. 8(*b*), a plane PL2 passing through the center point Co of the sphere Ob and perpendicular to a straight line L2 connecting the markers' center points Ca2 and Cb2 to each other can be constructed.

Wherein, if the intersection of the planes PL1 and PL2 can be calculated as the spin axis SA.

The spin axis may be calculated for each of the entire combinations by calculating the spin axis by the method as described above selecting by two pairs of center points of markers among combinations of three or more pairs of center points of markers. The final spin axis may be determined using the plurality of spin axes calculated in this way. For example, the average value of the plurality of spin axes may be determined as the final spin axis.

Meanwhile, when the spin axis is calculated as described above, vectors each of which is in a direction perpendicular to the spin axis are calculated from each of center points of a pair of markers corresponding to each other. And the calculated vectors are projected on the reference plane perpendicular to the spin axis, respectively. A spin amount centered on the spin axis may be calculated using the vectors each of which is projected on the reference plane.

As shown in FIG. 9, the reference plane PO perpendicular to the spin axis SA is defined, vectors each of which is in a direction perpendicular to the spin axis SA are calculated from each of center points of the pair of matched markers indicated on the sphere Ob, and each of the calculated vectors can be projected to the reference plane PO by an orthogonal projection.

As shown in FIG. 9, the center point of the spin axis SA projected on the reference plane PO is Cp point, the vector perpendicular to the spin axis SA at point Ca1 may be projected as a vector v1 from point Pa1 to point Cp on the reference plane PO, the vector perpendicular to the spin axis SA at point Cb1 may be projected as a vector v2 from point PM to point Cp on the reference plane PO, the vector perpendicular to the spin axis SA at point Ca2 may be projected as a vector v3 from point Pa2 to point Cp on the reference plane PO, and the vector perpendicular to the spin axis SA at point Cb2 may be projected as a vector v4 from point Pb2 to point Cp on the reference plane PO.

Accordingly, the spin amount Q1 can be calculated around the spin axis Cp using the vectors v1 and v2 projected on the reference plane PO, and the spin amount Q2 can be calculated around the spin axis Cp using the vectors v3 and v4 projected on the reference plane PO.

A value of the spin amount Q1 may be calculated using an angle formed by vectors v1 and v2 around the center point Cp on the reference plane PO and a circumference of a circle to which the sphere is projected on the reference plane. Alternatively, a length of an arc of Pa1-PM can be calculated as the value of the spin amount Q1 using a central angle in a triangle connecting Pa1-Pb1-Cp. Similarly, a value of spin amount Q2 can be calculated using an angle formed by vectors v3 and v4 around the center point Cp on the reference plane PO and the circumference of the circle. Alternatively, a length of an arc of Pa2-Pb2 can be calculated as the value of the spin amount Q2 using a central angle in a triangle connecting Pa2-Pb2-Cp.

An average value for the spin amount values Q1 and Q2 calculated as described above may be calculated as a final spin amount. If the number of spin amount values is calculated more, statistically accurate spin amount values can be calculated using statistical analysis (e.g., an average, a variance, a standard deviation, etc.) of each of these spin amount values.

However, as described above, because the camera's view is fixed, the spin amount from the first ball image to the second ball image includes the amount of rotation caused by the non-rotation movement from the first ball image to the second ball image (i.e., the amount of gaze rotation depending on the position in the image). Accordingly, it is necessary for the amount of gaze rotation to be subtracted from the previously calculated spin amount.

It may be seen from FIG. 10 that the amount of gaze rotation occurs due to a non-rotation movement from the first ball image to the second ball image.

While a golf ball is fixed to one side of a jig ZG as shown in FIG. 10 (*a*), when the golf ball in the fixed state is moved straight to the other side of the jig ZG as shown in FIG. 10 (*b*) and ball images before and after the movement of the golf ball are captured, respectively, when moving from the first ball image B1 shown in FIG. 10(*a*) to the second ball image B2 shown in FIG. 10(*b*), it may be seen that the amount of rotation occurred despite the non-rotation movement. That is, it can be seen that the amount of gaze rotation occurs for each position in the image.

Accordingly, the amount of rotation (the amount of gaze rotation) occurred during the non-rotation movement from the first ball image B1 to the second ball image B2 can be measured and preset. An accurate spin amount may be finally calculated by a correction for subtracting the preset amount of gaze rotation from the spin amount calculated in the manner described in FIGS. 7 to 9.

Such the amount of gaze rotation may be pre-measured, and the pre-measured amount of gaze rotation may be preset to be considered in the camera calibration process. Alternatively, whenever the user takes a golf shot, the amount of gaze rotation as described above can be calculated and the spin amount can be corrected using the calculated amount of gaze rotation.

As described above, the spin calculation method for golf ball moving by being hit and spin calculation apparatus using same according to the present invention have features that when the camera captures a hit golf ball with a plurality of markers marked on the golf ball, it can quickly and accurately match markers between two consecutive ball images using the relative relationship between the plurality of the markers detected in the captured ball image so that it can speed up the spin calculation processing and increase the calculation accuracy of the spin of the moving golf ball.

INDUSTRIAL APPLICABILITY

The spin calculation method for golf ball moving by being hit and spin calculation apparatus using same according to the present invention is available in the field of golf analysis or virtual golf simulation systems based on analysis of ball hit by golf club during golf swing.

The invention claimed is:

1. A spin calculation method for a golf ball moving by being hit, the method comprising:

acquiring a first image and a second image, which are consecutive images for the golf ball with a plurality of markers to be hit and moved, respectively;

processing to obtain information on a reference marker and a plurality of peripheral markers around the reference marker for a plurality of markers on a first ball image corresponding to a golf ball in the first image;

specifying a combination of markers corresponding to the reference marker and the peripheral markers on the first ball image among markers in a second ball image corresponding to a golf ball in a second image; and processing to calculate a spin axis and a spin amount of the moving golf ball using each center point of a pair of markers corresponding to each other on the first ball image and the second ball image, wherein the specifying the combination of markers includes:

processing to calculate relative angle information on slope of each of the plurality of peripheral markers based on a slope of the reference marker on the first ball image as feature information;

processing to calculate relative angle information on slope of markers in each combination for every combination of an arbitrarily selected reference marker and a plurality of peripheral markers based on the selected reference marker on the second ball image; and specifying a combination of markers on the second ball image matched by matching the feature information on the first ball image with relative angle information on the markers on the second ball image.

2. The method according to claim 1, wherein the specifying the combination of markers includes:

specifying a combination of markers on the second ball image having a relative relationship being matched with a relative relationship of each of the plurality of peripheral markers to the reference marker on the first ball image.

3. The method according to claim 1, wherein the processing to calculate the spin axis and the spin amount includes:

representing each center point of a pair of markers corresponding to each other on the first ball image and the second ball image, on a single sphere; and determining a line where a line connecting each center point of each of the pairs of markers corresponding to each other and two or more planes derived from the center point of the sphere meet as the spin axis.

4. The method according to claim 3, wherein the processing to calculate the spin axis and the spin amount includes:

processing to calculate vectors each of which is in a direction perpendicular to the spin axis from each center point of the pair of markers corresponding to each other;

projecting each of the calculated vectors on a reference plane perpendicular to the spin axis; and processing to calculate the spin amount centered on the spin axis using the vectors projected on the reference plane.

5. The method according to claim 1, further comprising:

processing to calculate an amount of gaze rotation by position in the acquired image according to the camera's view fixed; and subtracting the calculated amount of gaze rotation from the calculated spin amount.

6. A spin calculation apparatus for a golf ball moving by being hit, the apparatus comprising:

a single camera that acquires a first image and a second image, which are consecutive images for the golf ball with a plurality of markers to be hit and moved, respectively, wherein the single camera is provided separately from a camera system of a sensing device that detects a motion of the golf ball;

a marker matching processor that processes to obtain information on a reference marker and a plurality of peripheral markers around the reference marker for a plurality of markers on a first ball image corresponding to a golf ball in the first image, and specifies a combination of markers corresponding to the reference marker and the peripheral markers on the first ball image among markers in a second ball image corresponding to a golf ball in a second image; and a spin calculator that processes to calculate a spin axis and a spin amount of the moving golf ball by geometric calculation using each center point of a pair of markers corresponding to each other on the first ball image and the second ball image, wherein the marker matching processor is configured to receive coordinate information on which the golf ball is placed from the sensing device, set a region of an image to be acquired by the single camera as a region of interest based on the coordinate information, and obtain the set region of interest as the first image and the second image.

7. The apparatus according to claim 6, wherein the marker matching processor is configured to:

process to calculate relative angle information on slope of each of the plurality of peripheral markers based on a slope of the reference marker on the first ball image as feature information, process to calculate relative angle information on slope of markers in each combination for every combination of an arbitrarily selected reference marker and a plurality of peripheral markers based on the selected reference marker on the second ball image, and specify a combination of markers on the second ball image matched by matching the feature information on the first ball image with relative angle information on the markers on the second ball image.

8. The apparatus according to claim 6, wherein the spin calculator is configured to:

represent each center point of a pair of markers corresponding to each other on the first ball image and the second ball image, on a single sphere, and determine a line where a line connecting each center point of each of the pairs of markers corresponding to each other and two or more planes derived from the center point of the sphere meet as the spin axis, and process to calculate vectors each of which is in a direction perpendicular to the spin axis from each center point of the pair of markers corresponding to each other, project each of the calculated vectors on a reference plane perpendicular to the spin axis, and process to calculate the spin amount centered on the spin axis using the vectors projected on the reference plane.

9. A spin calculation apparatus for a golf ball moving by being hit, the apparatus comprising:

a marker matching processor that receives a first image and a second image, which are consecutive images for the golf ball with a plurality of markers to be hit and moved from a camera of a sensing device that detects a motion of the moving golf ball so as to process to obtain information on a reference marker and a plurality of peripheral markers around the reference marker for a plurality of markers on a first ball image corresponding to a golf ball in the first image, and specify a combination of markers corresponding to the reference marker and the peripheral markers on the first ball image among markers in a second ball image corresponding to a golf ball in a second image; and a spin calculator that processes to calculate a spin axis and a spin amount of the moving golf ball by geometric calculation using each center point of a pair of markers corresponding to each other on the first ball image and the second ball image, wherein the marker matching processor is configured to:

process to calculate relative angle information on slope of each of the plurality of peripheral markers based on a slope of the reference marker on the first ball image as feature information, process to calculate relative angle information on slope of markers in each combination for every combination of an arbitrarily selected reference marker and a plurality of peripheral markers based on the selected reference marker on the second ball image, and specify a combination of markers on the second ball image matched by matching the feature information on the first ball image with relative angle information on the markers on the second ball image.

10. The apparatus according to claim 9, wherein the spin calculator is configured to:

represent each center point of a pair of markers corresponding to each other on the first ball image and the second ball image, on a single sphere, and determine a line where a line connecting each center point of each of the pairs of markers corresponding to each other and two or more planes derived from the center point of the sphere meet as the spin axis, and process to calculate vectors each of which is in a direction perpendicular to the spin axis from each center point of the pair of markers corresponding to each other, project each of the calculated vectors on a reference plane perpendicular to the spin axis, and process to calculate the spin amount centered on the spin axis using the vectors projected on the reference plane.

* * * * *